US006974089B2

(12) United States Patent
Neumaier et al.

(10) Patent No.: US 6,974,089 B2
(45) Date of Patent: Dec. 13, 2005

(54) INJECTOR

(75) Inventors: Martin Neumaier, Regensburg (DE); Karin Wels, Thalmassing (DE)

(73) Assignee: Siemens Aktiengesellschaft, Munich (DE)

( * ) Notice: Subject to any disclaimer, the term of this patent is extended or adjusted under 35 U.S.C. 154(b) by 41 days.

(21) Appl. No.: 10/818,398

(22) Filed: Apr. 5, 2004

(65) Prior Publication Data

US 2004/0195389 A1 Oct. 7, 2004

Related U.S. Application Data

(63) Continuation of application No. PCT/DE02/03719, filed on Oct. 1, 2002.

(30) Foreign Application Priority Data

Oct. 4, 2001 (DE) ..... 101 48 874

(51) Int. Cl.[7] ..... F02M 47/02; F02M 45/10; F02M 59/00; B05B 1/30

(52) U.S. Cl. ..... 239/88; 239/89; 239/90; 239/91; 239/92; 239/93; 239/95; 239/533.1; 239/533.2

(58) Field of Search ..... 239/88–93, 95, 239/390, 396, 533.1, 533.2, 533.3, 585.1–585.5, 239/600

(56) References Cited

U.S. PATENT DOCUMENTS

| | | | | |
|---|---|---|---|---|
| 3,859,996 A | * | 1/1975 | Mizzy et al. | 604/70 |
| 4,778,355 A | * | 10/1988 | Holland | 417/378 |
| 5,019,052 A | * | 5/1991 | Rohrbough | 604/203 |
| 5,779,149 A | | 7/1998 | Hayes, Jr. | |
| 5,806,766 A | | 9/1998 | Krueger et al. | |
| 5,857,662 A | | 1/1999 | Kappel et al. | |
| 5,875,632 A | | 3/1999 | Kappel et al. | |
| 6,062,533 A | | 5/2000 | Kappel et al. | |
| 6,066,912 A | | 5/2000 | Fitzner et al. | |
| 6,119,952 A | | 9/2000 | Kappel et al. | |
| 6,145,492 A | | 11/2000 | Lixl | |
| 6,148,842 A | | 11/2000 | Kappel et al. | |
| 6,168,132 B1 | | 1/2001 | Frank et al. | |
| 6,186,474 B1 | | 2/2001 | Fitzner et al. | |
| 6,194,812 B1 | | 2/2001 | Klügl et al. | |
| 6,530,558 B1 | | 3/2003 | Schulz | |

FOREIGN PATENT DOCUMENTS

| | | |
|---|---|---|
| DE | 199 35 261 A1 | 2/2001 |
| EP | 0 449 763 A1 | 10/1991 |
| EP | 0 451 408 A1 | 10/1991 |
| WO | 01/07780 A1 | 2/2001 |

* cited by examiner

*Primary Examiner*—Davis Hwu
(74) *Attorney, Agent, or Firm*—Laurence A. Greenberg; Werner H. Stemer; Ralph E. Locher

(57) ABSTRACT

An injector has two interconnected main sections, a body section and an injector section. The injector section is connected to the body section by way of a form lock, and the connection is produced by a partial material connection. The injector is preferably suitable for use in a fuel-injection device for an internal combustion engine.

9 Claims, 2 Drawing Sheets

INJECTOR

CROSS-REFERENCE TO RELATED APPLICATION

This application is a continuation, under 35 U.S.C. § 120, of copending international application No. PCT/DE02/03719, filed Oct. 1, 2002, which designated the United States; this application also claims the priority, under 35 U.S.C. § 119, of German patent application No. 101 48 874.2, filed Oct. 4, 2001; the prior applications are herewith incorporated by reference in their entirety.

BACKGROUND OF THE INVENTION

FIELD OF THE INVENTION

The invention relates to an injector with two interconnected main sections. The device comprises a body section and an injector section. The injector section is joined to the body section by way of a positive connection, i.e., a form lock, and the connection is produced via a partial integral material connection.

An injector device is described in, and reference is made to, European patent EP 0 449 763 B1 (cf. FIG. 1 and FIG. 2), and also European patent application EP 0 451 408 A1 (cf. FIG. 1).

Each of the prior art injector devices is intended for use in a fuel injection system for an internal combustion engine and comprises as essential components an injector section, which carries the nozzles intended for injecting the fuel, and a body section, to which the injector section is connected and which carries the further functionally important components of the injector, in particular a nozzle needle, guides and the like, and which also serves for securing the injector to further components of the injection system or the internal combustion engine. In each case the body section and the injector section are connected to each other by way of a screw connection.

According to the first-named document, one of the two main sections has an external thread and a tensioning part in the manner of a nut with an internal thread is formed to fit onto the corresponding other main section.

According to the second-named document, the tensioning part with the internal thread is formed to fit onto the body section and the injector section ending with a flange is tightened onto the body section by way of a collar which carries an external thread and is screwed into the internal thread of the tensioning part.

German published patent application DE 199 35 261 A1 (see U.S. Pat. No. 6,530,558 B1) disclose an injector device having two interconnected main sections, comprising a body section in the form of a valve seat support and an injector section in the form of a valve seat element. The valve seat element and the valve seat support are connected to each other by means of a positive connection. The positive connection comprises a partial material connection in the form of an annular encircling weld seam between the valve seat support and the valve seat element.

The presently relevant technological background is described in the following United States patent documents: U.S. Pat. Nos. 5,857,662; 5,875,632; 5,806,766; 6,194,812; 5,779,149; 6,066,912; 6,148,842; 6,186,474; 6,168,132; 6,062,533; 6,145,492; 6,119,952.

During the closing of the screw connection that is present in every prior art injector device there is produced, due to friction, a frictional torque which attempts to cause the injector section to rotate as well. In order to prevent a co-rotation of this kind, the injector section is expediently pressed onto the body section with appropriate force while the screw connection is being formed. The axial force with which the injector section is pressed against the body section in the finished injector device is greatly dependent on the coefficient of friction in the screw connection, as a result of which strong fluctuations in this axial force can occur in the course of mass production of injectors of this kind.

SUMMARY OF THE INVENTION

It is accordingly an object of the invention to provide an injector device, which overcomes the above-mentioned disadvantages of the heretofore-known devices and methods of this general type and which, particularly , avoids the problems occurring in the manufacture of existing injector devices and in which the axial force that is generated during tightening is defined explicitly and in a reproducible manner.

With the foregoing and other objects in view there is provided, in accordance with the invention, an injector, comprising:

two interconnected main sections, namely a body section formed with a recess and an injector section;

a tensioning part projecting over the recess formed in the body section and connecting the body section with the injector section;

a collar disposed in the recess, the collar forming a form lock with the body section and with the tensioning part; and a partial connection interconnecting the injector section and the body section, the partial connection being an integral material connection between the collar and the tensioning part.

In other words, the objects of the invention are achieved with an injector section that is connected to the body section by way of a positive connection (form-lock), and the connection is produced by a partial integral material connection and wherein the connection is effected by means of a tensioning part which projects above a recess provided in the body section, in which recess a collar is disposed, the collar forming a positive fit with the body section and the tensioning part and the partial connection between the collar and the tensioning part is formed as a material connection.

According to the invention, the positive fit joining the body section and the injector section is accordingly created not merely by means of a friction locking connection as previously, but by means of a material connection. By this means it is possible to set the force between the body section and the injector section to a value appropriate to the circumstances independently of requirements of the manufacturing process. The difficulties which result during the manufacture of a screw connection are thus avoided.

The partial connection is preferably a welded joint. This welded joint can be formed after the parts of the injector to be connected to one another have been clamped together in a suitable clamping device in a predefined and reproducible manner.

The partial connection preferably also defines a closed line and consequently is created as a unit, and not, say, as an arrangement of individual partial connections. This ensures a maximum load carrying capacity and durability of the connection.

The tensioning part in the injector preferably has no screw thread, but instead is smooth on surfaces which serve a functional purpose.

Furthermore the tensioning part is preferably formed to fit onto one of the main sections to be connected to each other, in particular onto the injector section.

A particularly preferred embodiment of the injector is wherein the tensioning part projects over the sleeve or collar which is inserted in a recess in a main section, and the partial connection is formed between the tensioning part and the collar. This has the particular advantage that with regard to the partial connection to be produced the choice of both the material for the body section and the material for the injector section is not a critical factor. In particular it may happen that the material of the body section is only poorly suited to welding, which would, at the very least, make it considerably more difficult to form a suitable partial connection directly on the body section. On the other hand it is no problem to choose an easily weldable material for the injector section. Then a collar can be used which is inserted into a suitable recess in the body section and above which the tensioning part formed to fit onto the injector section projects when the injector section is tightened to the body section. The positive partial connection necessary for the connection can then be implemented as a welded joint between the tensioning part and the collar, for example by laser welding.

The injector section of the injector is preferably circular cylinder symmetrical.

The injector is particularly preferably used in a fuel injection device for an internal combustion engine. Consideration is given in particular to the use of an injector of this kind in a common-rail injection device for a multi-cylinder diesel engine.

Other features which are considered as characteristic for the invention are set forth in the appended claims.

Although the invention is illustrated and described herein as embodied in an injector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
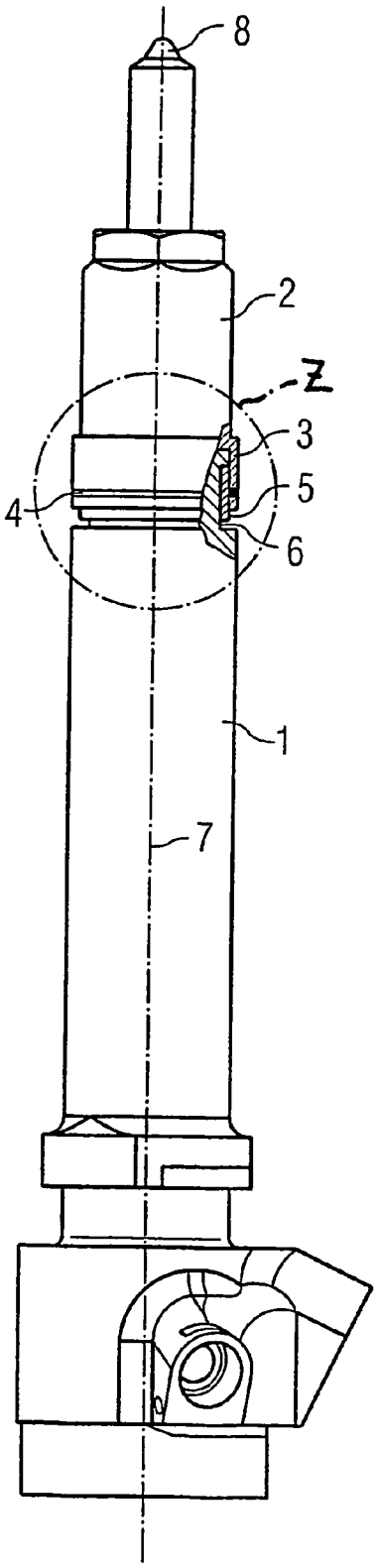
FIG. 1 is a side elevation of an injector according to the invention.
Figure 2:
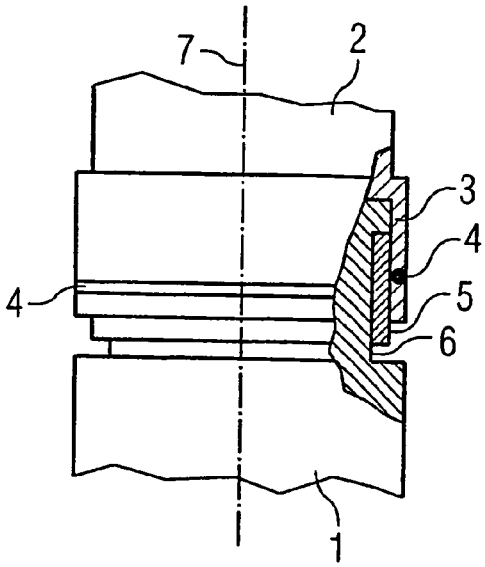
FIG. 2 is an enlarged view of the detail encircled in FIG. 1.
Figure 3:
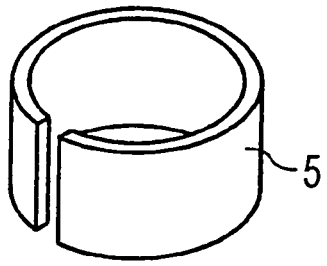
FIGS. 3–6 are perspective views of exemplary embodiments of the collar for use in the injector depicted in the previous figures.
Figure 4:
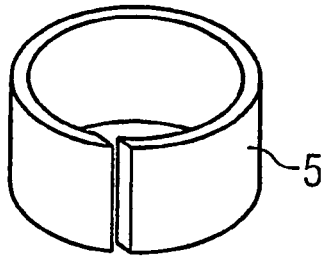
Figure 5:
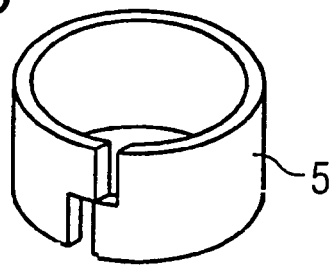
Figure 6:
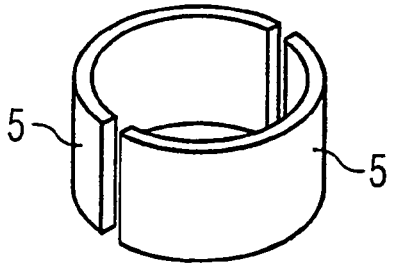

Referring now to the figures of the drawing in detail and first, particularly, to FIGS. 1 and 2 thereof, there is shown an exemplary embodiment of the invention. FIG. 2 is an enlarged representation of the part that is encircled and identified with a "Z" in FIG. 1.

The injector comprises two interconnected main sections 1 and 2, specifically a body section 1 and an injector section 2. In the area of their connection 3, 4, 5, the two main sections 1 and 2 are circular cylindrical and they are symmetrical with respect to an axis 7. At a pointed end 8, the injector section 2 carries nozzles for discharging a fluid which, in the specific exemplary case, is diesel fuel. A tensioning part 3 in the form of a ring is formed onto the injector section 2, and the ring 3 projects partially over the body section 1 in the assembled state. Here, the tensioning part 3 projects over a recess 6 provided in the body section 1, in which recess a collar 5 is disposed which forms a positive fit with the body section 1 and the tensioning part 3. In order to form the connection 3, 4, 5, after the parts are assembled together, the body section 1 and the injector section 2 are initially pressed onto each other with a predetermined force. After this, a partial material connection 4 (i.e., an integral material connection) is formed, in the present embodiment as a welded joint which forms a closed line and penetrates the tensioning part 3 fully and the collar 4 partially. In this way the tensioning part 3 and the collar 4 are joined to each other by an integral material connection. The friction fit between the injector section 2 and the body section 1 is further achieved by means of the collar 5, which is connected to the body section 1 by friction locking, i.e., form locking.

It is noted, in this context, that a form-locking connection, i.e., a positive connection, is one that connects two elements together due to the shape of the elements themselves, as opposed to a force-locking connection, i.e., a friction lock, which locks the elements together by friction or by force external to the elements.

The question will be left open as to whether certain individual cases permit the collar 5 to be implemented as a closed ring and for example to be shrink-fitted into the recess 6. FIGS. 3 to 6 show four exemplary embodiments of this collar 5, whereby in each exemplary embodiment the collar 5 is a split ring interrupted by a gap or gaps. In this way it can be pushed over the body section 1 relatively easily and introduced into the recess 6—refer to FIGS. 1 and 2. The encircling welded joint 4 ensures that the gaps in the collar 5 due to the manufacturing process have no functional impact whatsoever on the injector because the collar is welded to the tensioning part 3.

The injector according to the invention is particularly easy to manufacture and is characterized by optimum functional attributes.

We claim:

1. An injector, comprising:

a body section formed with a recess;

an injector section;

a tensioning part projecting over said recess formed in said body section and connecting said body section with said injector section;

a collar disposed in said recess, said collar forming a form lock with said body section and with said tensioning part; and a partial connection interconnecting said injector section and said body section, said partial connection being an integral material connection between said collar and said tensioning part.

2. The injector according to claim 1, wherein said partial connection is a welded joint.

3. The injector according to claim 1, wherein said partial connection defines a closed line.

4. The injector according to claim 3, wherein said tensioning part is formed without a screw thread.

5. The injector according to claim 1, wherein said tensioning part is formed to fit onto one of said injector section and said body section.

6. The injector according to claim 5, wherein said tensioning part is integrally formed on said injector section.

7. The injector according to claim 1, wherein said injector section is circular cylinder symmetrical.

8. The injector according to claim 1 formed as a fuel injector for an internal combustion engine.

9. In combination with an internal combustion engine, the injector according to claim 1 formed as a fuel injector.

* * * * *